United States Patent [19]

Stokes

[11] 4,064,563

[45] Dec. 27, 1977

[54] BILLIARD GLOVE

[76] Inventor: Alvin R. Stokes, 700 N. Zimmer, Pampa, Tex. 79065

[21] Appl. No.: 712,517

[22] Filed: Aug. 9, 1976

Related U.S. Application Data

[63] Continuation of Ser. No. 557,907, March 13, 1975, abandoned.

[51] Int. Cl.[2] ..... A41D 19/00

[52] U.S. Cl. ..... 2/161 A; 273/14

[58] Field of Search ..... 273/2, 54, 14; 2/20, 2/21, 1, 16, 158, 159, 170, 160, 161 A, 162, 163; 128/157, 165

[56] References Cited

U.S. PATENT DOCUMENTS

| | | | |
|---|---|---|---|
| 136,157 | 2/1873 | Hall | 2/21 X |
| 136,640 | 3/1873 | Bond | 2/21 X |
| 1,362,461 | 12/1920 | Anast | 2/21 |
| 2,409,101 | 10/1946 | Brittingham | 2/21 |
| 2,751,592 | 6/1956 | Longstreth et al. | 2/21 |
| 2,949,610 | 8/1960 | Lutsik | 2/161 A |
| 3,096,523 | 7/1963 | Bruchas | 2/159 |
| 3,123,832 | 3/1964 | Kusik | 2/20 X |
| 3,229,306 | 1/1966 | Bazar | 2/161 A |

FOREIGN PATENT DOCUMENTS

| | | | |
|---|---|---|---|
| 1,369,291 | 6/1964 | France | 2/21 |

*Primary Examiner*—William H. Grieb
*Assistant Examiner*—T. Brown
*Attorney, Agent, or Firm*—Ely Silverman

[57] ABSTRACT

A three-fingered panelled smoothly fitted glove provides for uninhibited contact of the skin of the ring and little fingers with a billiard or like table while providing seam-free contact of the index and middle fingers and thumb with the billiard or like cue for controlled slidable support of the cue. An elastic friction pad panel at the ulnar side of the hand improves support of the cue and player by preventing slipping as well as maintaining an adequately firm yet yieldable attachment of the glove to the wearer's hand.

4 Claims, 17 Drawing Figures

FIG.10
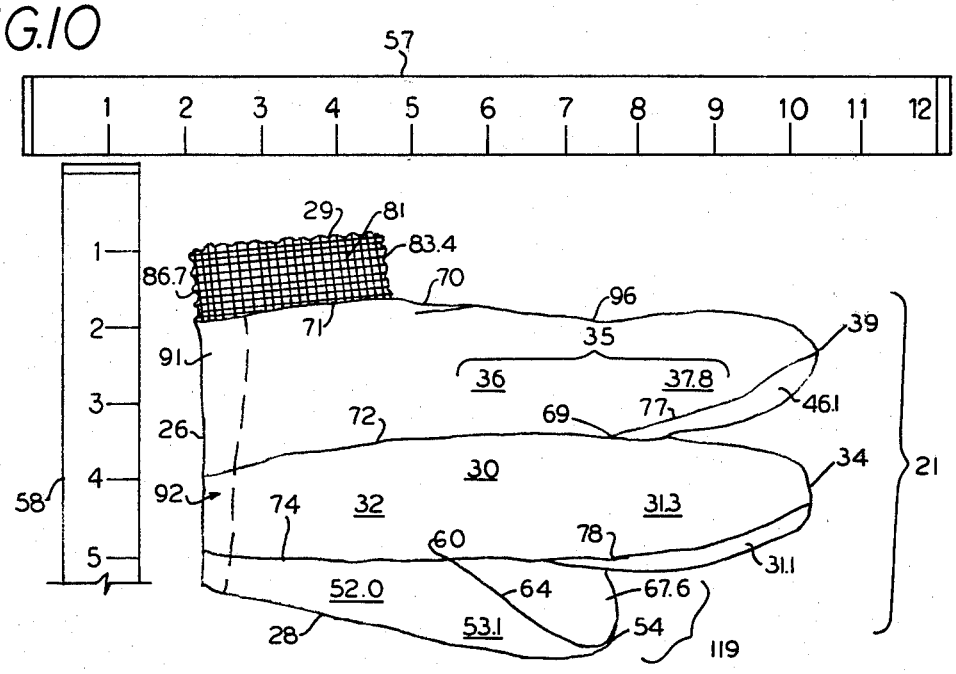
FIG.11
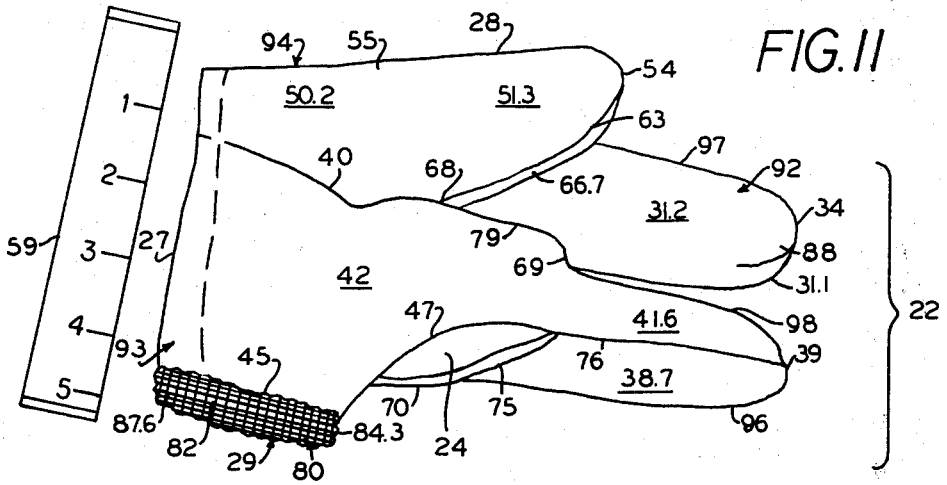
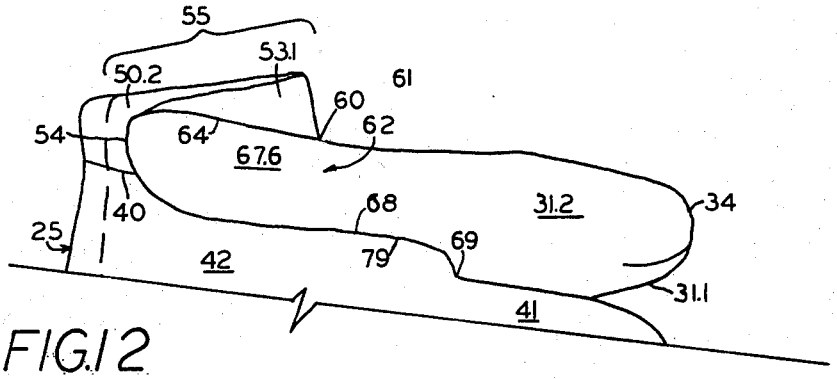
FIG.12

FIG.13
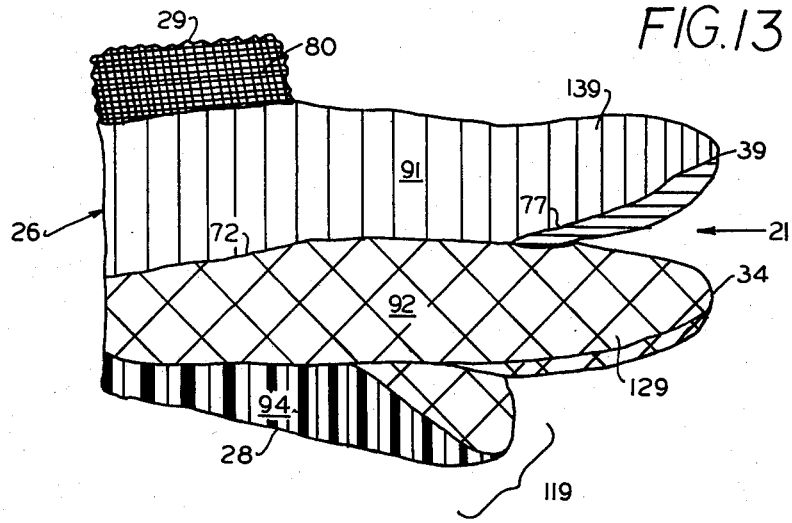
FIG.14
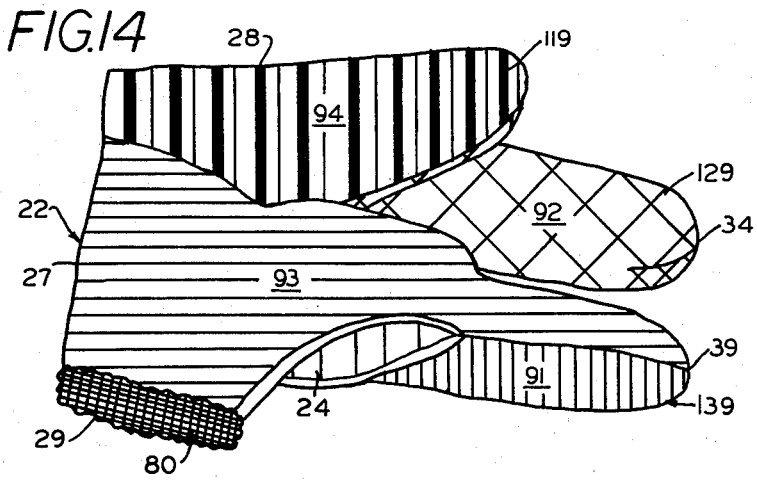
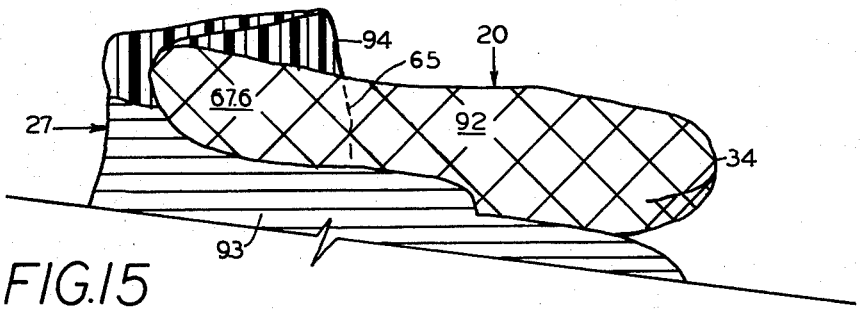
FIG.15

BILLIARD GLOVE

This is a continuation of application Ser. No. 557,907 filed Mar. 13, 1975.

BACKGROUND OF THE INVENTION

1. The field of the Invention

The fields of art to which this invention pertains are billiards, hand and arm protectors, and sports gloves.

2. Description of the Prior Art

While gloves for particular purposes are known, e.g. golf gloves as in U.S. Pat. No. 3,255,462; bowling gloves as in U.S. Pat. Nos. 3,229,306 and 3,606,317; basketball glove as in U.S. Pat. No. 3,707,733; and bricklaying glove as in U.S. Pat. No. 945,818, a glove of particular use in billiards and the like has not been available, so that dusting of the player's hands with powder to minimize friction between cue stick is presently common practice as it has been for over 50 years, notwithstanding that such practice is undesirable at least because of the residue frequently thereby left on billiard tables, and the psychological reluctance of some players to use talcum powder. Use of ordinary gloves by a billiard player interferes with the varied finger and palm positions required by a billiard player—which positions are shown by FIGS. 1–9 herein—as well as interferes with control of movement of the cue past such gloved finger.

SUMMARY OF THE INVENTION

The apparatus of this invention involves synergistic concepts and structures; firstly, exposure of the skin of fourth and fifth fingers of a billiard player's hand to contact the table providing maximum sensitivity and accuracy of hand and cue positioning and control, while simultaneously covering the surfaces of the thumb, index and middle fingers where contacted by cue stick surface by a low friction fabric provides for improved ease and control of movement of the cue; secondly, a cooperative array of dimensionally stable glove panels is used whereby to reduce mechanical stress on the hands yet allow different sizes of such panels to be economically made for different size players, while those panels are held together by seams located so as to not interfere with cue movement; and thirdly, an elastic panel element is utilized not only to hold the dimensionally stable fabric panels adequately firmly on the hand, but also to provide improved frictional engagement of the player's hand with the billiard table and so improve reliability and control of the player's position at the time the billiard ball or the like is struck with the cue, when the player's hand is so extended over the surface of the table as to benefit from such support.

BRIEF DESCRIPTION OF THE DRAWINGS

FIGS. 1, 2 and 3 show the position of the portions of the digits of the wearer in dashed lines relative to the outline of the glove 20.

FIG. 1 is a view of the glove 20 on the hand of the wearer as seen along the direction of the arrow 1A of FIG. 3 to illustrate the radial, thumb, or lateral side of the glove 20 in one operative position.

FIG. 2 illustrates the right, ulnar, quintal or central side of the glove 20 in the same position of the glove 20 and wearer as shown in FIG. 1 and as seen along the direction of the arrow 2A of FIG. 3.

FIG. 3 is a top view along direction of arrow 3A of FIG. 1.

FIG. 4 is a side view in the direction of arrow 4A of FIG. 6 to show an ulnar side view of the position of parts of the glove 20 and hand 101 in the position of such parts shown in FIGS. 4, 5, and 6.

FIG. 5 is a view of the glove 20 on the hand 101 of the wearer 100 using a cue 102 while in the position of parts of hand and glove shown in FIGS. 4 and 6, as seen in direction of arrow 5A of FIG. 6.

FIG. 6 is a top view of the position of parts of hand and glove as seen along direction of arrow 6A of FIG. 4 with finger portions shown in dashed lines.

FIG. 7 is a view taken from radial or thumb side generally as shown in the direction of arrow 7A of FIG. 8; while FIG. 8 is a generally top view of the position of the parts as shown in FIG. 7 and FIG. 9 is an ulnar or quintal view shown in direction of arrow 9A of FIG. 8.

FIGS. 10, 11, and 12 show the empty glove 20 in a flattened position of parts. FIG. 10 shows the dorsal or top surface 21 of the glove 20; FIG. 11 is a palmar or bottom view showing the opposite side of the glove 20 in the same position of parts as shown in FIG. 10; and FIG. 12 shows the dorsal portion 67.6 of the thumb medial panel folded proximally toward the wrist or proximal edge 25 of the glove 20 from the zone or junction 62 to expose the dorsal panel portion 67.6 of the thumb medial panel portion of the index panel 92.

The rulers 57, 58 and 59 of FIGS. 10 and 11 are each provided with digits shown thereon indicating 1-inch spacing.

FIGS. 10, 11, 12, 13, 14 and 15 are drawn to scale and to the same scale shown by rulers 57, 58, and 59 in FIGS. 10 and 11, whereby measurements may be made thereon and quantitative description made to more particularly point out applicant's invention.

Figure 6:
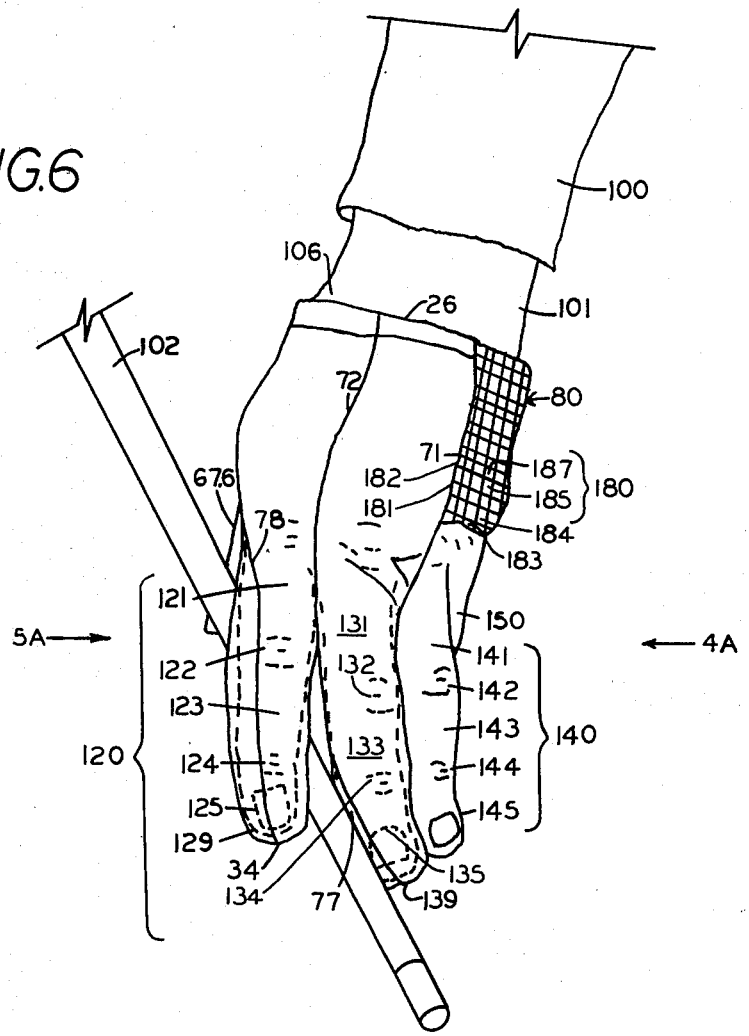
Figure 16:
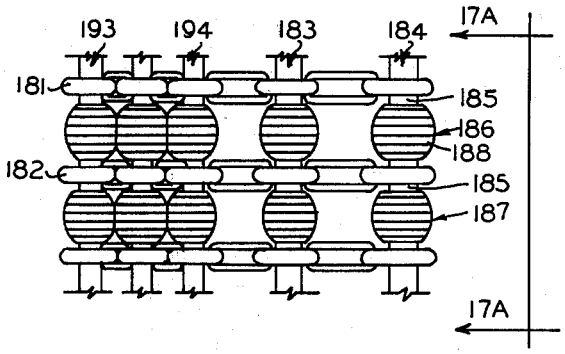

FIG. 16 is a diagrammatic and highly enlarged top view of zone 180 of FIG. 6 in which zone the pads 186 and 187 are located. FIG. 16 pad assemblies 193–194 of panel 80 are diagrammatically shown in their normally transversely contracted position while assemblies 183 and 184 thereof are diagrammatically shown in the elastically expanded position of panel 80.

Figure 17:
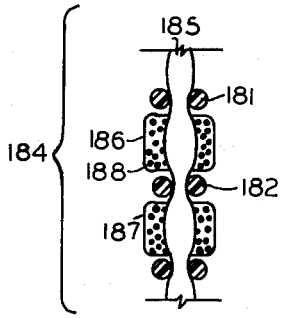

FIG. 17 is a diagrammatic longitudinal transverse cross-sectional view along sectional plane 17A—17A of FIG. 16.

DESCRIPTION OF THE PREFERRED EMBODIMENT

1. Definition of Terms

The terms for the relative directions herein given refer to the palmar surface of the glove as shown in FIG. 11 when the wearer would be in the supine position with the palm of his hand and the palm surface 42 of glove 20 pointing forward or vertically with the thumb of the wearer being adjacent the radius bone and the most lateral portion of the glove and most adjacent to the radius bone of the wearer, and the small finger of the hand of the wearer being more central to the body of the wearer (or medial) and adjacent to the ulna bone of the wearer and with the edge 25 of the glove being proximal to the wearer's body and the points 34 and 39 on the glove 20 being distant from the wrist (and/or distal to the wrist) being referred to as distal. As the wearer rotates or pronates his wrist from the above described position in the position shown in FIGS. 1–9, the thumb side of the glove (upper side as shown in FIGS. 11, 12, 14 and 15) is referred to as the thumb or radial edge 28 as shown in FIGS. 11 and 14, while the side opposite thereto, next to the fifth finger or digitus quintus and ulnar bone, is called the quintal or ulnar edge 29 as shown in FIGS. 11 and 14 to avoid use of terms "lateral" and "central."

Referring to FIGS. 11, 12, 14 and 15, of the drawings, the directions of (a) distal and (b) proximal and (c) thumb or radial and (d) quintal or ulnar as used therein, denote, respectively, the (a) rightwards, (b) leftwards, (c) upwards and (d) downwards direction and relation of the parts of the glove 20, as shown in FIGS. 11, 12, 14 and 15 corresponding to the use of such anatomical terms in those figures as properly applied to anatony of a human wearer of the glove 20. The same directions (a) – (d) are used in all figures and text description herein in view of the denotation of the terms quintal and "ulnar" in FIGS. 10 and 13 as upward and, in FIGS. 10 and 13, the thumb being at the bottom of such figures and differing relative directions of wrist edge 25 of the glove 20 to the distal ends 34 and 39 the glove 20 in FIGS. 2, 4, and 9.

Figure 2:
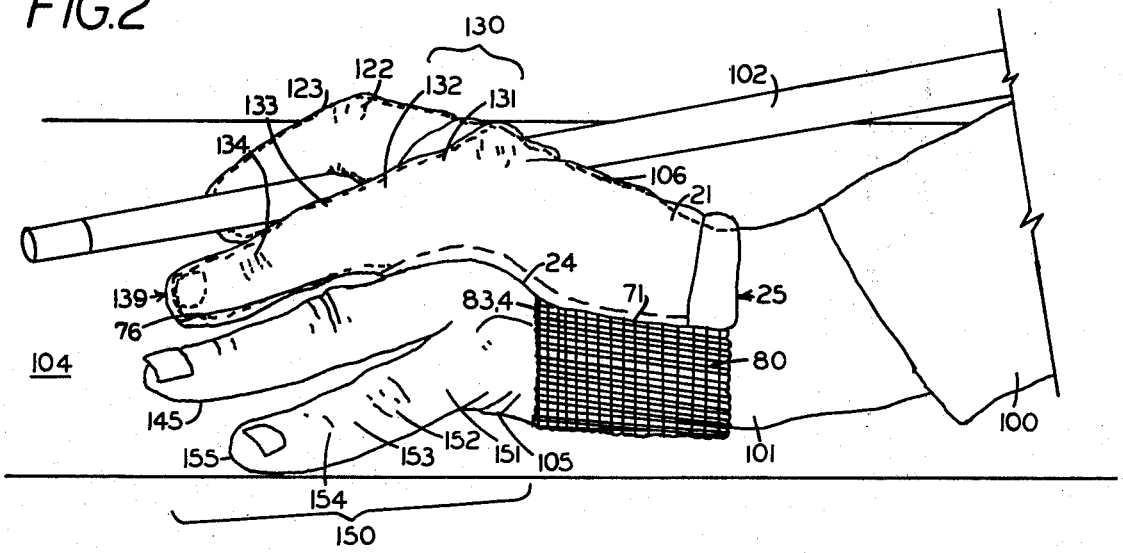
Figure 4:
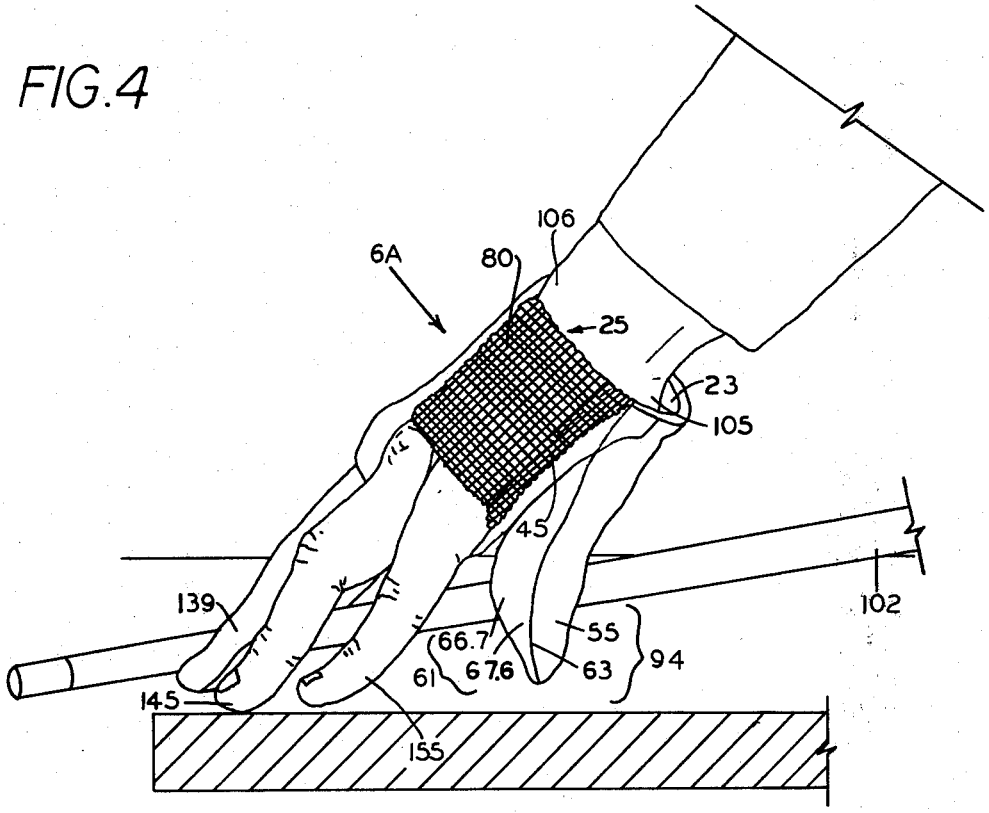
FIGS. 4, 5 and 6 illustrate the position of the parts of the glove 20 on the hand 101 of wearer 100 in another position of use of the glove 20; with wearer of glove handling a cue stick at a lower height relative to the tips of the wearer's fingers than in FIGS. 1–3.

The terms "dorsal" and "palmar" refer to the portions of the glove in contact with the dorsal (106) and palmar (105) surfaces of the hand of the wearer as shown in FIGS. 2 and 4.

2. Structure and Arrangement of the Portions of the Glove

The glove assembly 20 extends from wrist or proximal edge 25, having a dorsal portion 26 and a palmar portion 27, to a left or radial or thumb edge 28 to an ulnar, or quintal, edge 29 and to the distal tips 34 and 39 of the index and middle finger portions respectively of the glove 20. The glove 20 comprises a dorsal fabric panel portion assembly 21, and palmar panel portion assembly 22 which form a proximal wrist opening 23 and a distal finger opening 24. It is shown to scale in FIGS. 10, 11 and 12.

The dorsal and palmar panel portion assemblies are formed by a cooperative assembly of foldable flexible cloth panels—portions of which appear in both dorsal and palmar assemblies. The flexible cloth panels which form the glove 20 are, as shown in FIGS. 13, 14 and 15 a dorsal center cloth panel 91, an index finger panel 92, a central palmar panel 93, a thumb panel 94 and a quintal panel 80. The shapes and size of such panels are as shown in FIGS. 10–15 to scale of ruler 57, 58, 59.

As shown in FIGS. 10–15, the central palmar panel 93 is joined at its radial edge by seams 40 and 78 to ulnar edges of panels 92 and 94. The thumb panel 94 extends from the palmar seam 40 to the dorsal seam 74 and is joined along dorsal seams 74 and 64 to the dorsal side of panel 92. Panel 92 is on its dorsal side joined at dorsal seam 72 to panel 91. Panel 91 is joined by dorsal digital seam 77 to a dorsal digital portion of palmar panel 93 and by dorsal seam 71 to quintal panel 80. Panel 80 is joined by central palmar seam 45 to the ulnar proximal edge of panel 93.

The panels 91, 92, 93 and 94 are each formed of a porous yet sturdy smooth surfaced flexible woven cloth, a plain weave (1 × 1) of polyester fiber, 40 fibers per strand, 80 strands per lineal inch, opaque to naked eyes. Panel 80 is a woven porous elastic fabric 1⅜ inches (3.4 cm) wide from dorsal seam 71 to palmar seam 45 (as shown in FIGS. 2 and 4) and 2½ inches (6.2 cm) long from proximal to distal edge and elastically stretchable to 2 inches width but not extensible as much as 2% lengthwise.

The dorsal assembly 21 comprises the portions of panels 91, 92, 94 and 80 as shown in FIG. 10; it comprises a dorsal index finger panel portion 30 of panel 92 which in turn comprises a distal dorsal index digital portion 31.3 which is continuous with and distal to a proximal dorsal index hand portion 32. The dorsal digital index portion 31.3 extends to and is continuous with a palmar digital portion 31.2 around the ulnar edge of the index panel 92 and extends to portion 31.1 on their thumb side (at zone 97 of FIG. 11).

The dorsal index finger panel portion 30 extends from the dorsal portion 26 of the wrist or proximal edge 25 of the glove assembly 20 to the distal tip of the index portion 34 as shown in FIGS. 10 and 13.

Another portion of the index panel, 92, the thumb medial panel portion 67.6, also partly appears in dorsal view as shown in FIGS. 10 and 13 but more fully in FIGS. 12 and 15.

A dorsal base portion 53 of the thumb panel 94 overlies the base portion of the wearer's thumb, which (base) portion overlies the metacarpal bone portion (rather than the digital portion) of the thumb and extends distally from wrist edge 27 to a dorsal thumb seam junction 68: a digital panel 51.3 is continuous with:

a. Base panel digital portion 53.1 and (b) base thumb panel portion 52.0 which are continuous with (a)[1] thumb digital palmar portions 51.3 and (b)[1] thumb base palmar portions 50.2, respectively. The thumb dorsal digital portion 53.1 is joined at its ulnar edge by seam 64 to dorsal thumb edge of thumb medial panel portion 67.6 of the index panel 92.

The dorsal assembly 21 also includes the middle finger dorsal panel portion 35 (shown in FIG. 10) of dorsal center panel 91; the middle finger dorsal panel portion 35 has a proximal or a hand panel portion 36 which is continuous with a more distal digital dorsal portion 37.8. That digital portion 37.8 is continuous at its ulnar or quintal edge with a palmar portion 38.7 of the dorsal center panel 91 (palmar portion 38.7 is shown in FIG. 11). The middle finger dorsal portion of panel 91 extends to the distal tip 39 of the middle finger portion from the dorsal portion 26 of wrist or proximal edge 26 of the glove 20.

A dorsal portion 46.1 continuous with the middle hand portion 42 of the central palmar panel 93 is attached by the dorsal digital portion 77 of the dorsal center seam to the thumb side of the digital portion 37.8 of panel portion 35.

The dorsal portion of the rectangularly shaped quintal panel 80 is attached at its thumb or radial edge to the quintal edge of dorsal hand or base portion 36 of dorsal center panel 91. The distal dorsal edge 83.4, and palmar edge 84.3 of panel 80 and quintal edge dorsal portion 70 and palmar portion 75 outline finger opening 24 shown in FIGS. 11 and 14 for the wearer's ring finger, as 140, and little finger as 150 as shown in FIGS. 2, 3, 4, 6 and 9.

The quintal panel 80 is formed of elastic porous material and has a dorsal ulnar or quintal panel portion 81, a palmar panel portion 82 and a distal dorsal edge 83.4 and a palmar distal edge 84.3. The proximal edge of panel 80 has a dorsal edge portion 86.7 and a palmer edge portion 87.6. Each such edge portion (86.7 and 87.6) is continuous with each other around the ulnar side of panel 80, as are edges 84.3 and 83.4; dorsal and palmar panel edges 86.7 and 87.6 are, respectively, continous with and a part of dorsal and palmar wrist edge portion 26 and 27.

3. Palmar Panel Assembly

The palmar assembly 22 comprises the portions of panels 91–94 and 80 shown in FIGS. 11 and 14 and is composed generally, in cooperative combination, of the central palmar panel 93, and palmar portions of index panel 92, a portion of the dorsal medial panel 91 and the palmar portion of the thumb panel 94 and quintal panel 80. More particularly, the palmar assembly comprises a palmar surface middle finger digital portion 41.6 and a palmer surface middle hand portion 42 of central palmar panel 93; the middle hand portion 42 is proximal to and continuous with the digital palmar surface 41.6. The palmar surface of the middle finger digital portion 41.6 is continuous (as at 98) along its thumb or radial edge with the digital dorsal surface portion 46.1 of the central palmar panel 93 as shown in FIG. 10.

The palmar assembly 22 also includes the index finger palmar digital portion 31.2 (shown in FIGS. 11 and 12) of index panel 92 (shown in FIGS. 14 and 15); the index finger palmar digital portion 31.2 is continuous along its ulnar or quintal edge with the dorsal portion of the dorsal surface of the index finger panel 92, with dorsal surface panel 31.3 (shown in FIG. 10) and portion 31.2 is continuous at its thumb or radial edge with dorsal surface portion 31.1 (shown in FIG. 10).

The digital palmar portion 38.7 of panel 91 is (at 96) continuous on its ulnar edge with the digital dorsal portion 37.8 of the dorsal center panel 91 and is connected by a distally directed seam 76 to digital palmar surface portion 41.6.

The thumb panel 94 comprises on the palmar surface 22, a thumb central or proximal palmar surface 50.2 and, (on the palmar surface) a thumb panel palmar surface digital portion 51.2 which is distal to and continuous with a palmar surface central portion 50.2.

Figure 1:
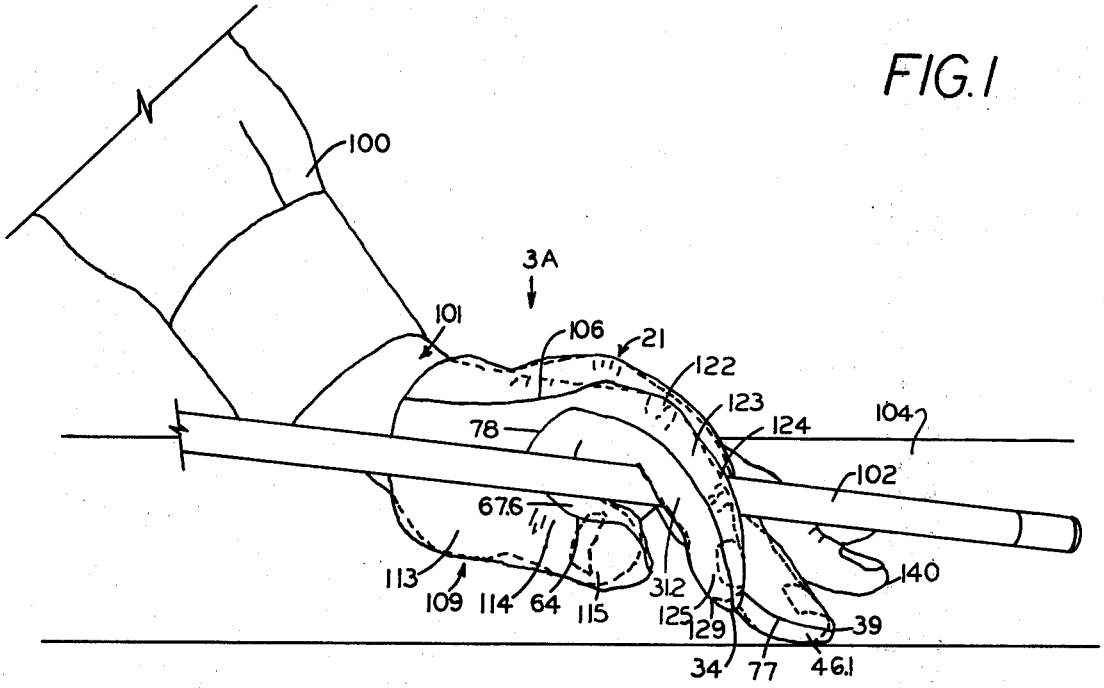
FIGS. 1, 2 and 3 illustrate the portion of apparatus 20 of the invention on the hand 101 of a wearer 100 of the apparatus of the invention in the same operative position of the glove at a common elevation of the cue by the hand and glove of the wearer.

The palmar surface portion 50.2 is, via radial edge 28, continuous on the dorsal side of the glove 20 with the thumb assembly dorsal proximal portion 52.0 (shown in FIG. 10) and the distal end of the dorsal central portion 52.0 is similarly continuous (as shown in FIGS. 1 and 10) with a digital thumb portion dorsal digital portion 53.1. The thumb panel 94 extends from the proximal or wrist edge 25 of the glove 20 to the thumb distal tip 54.

Figure 3:
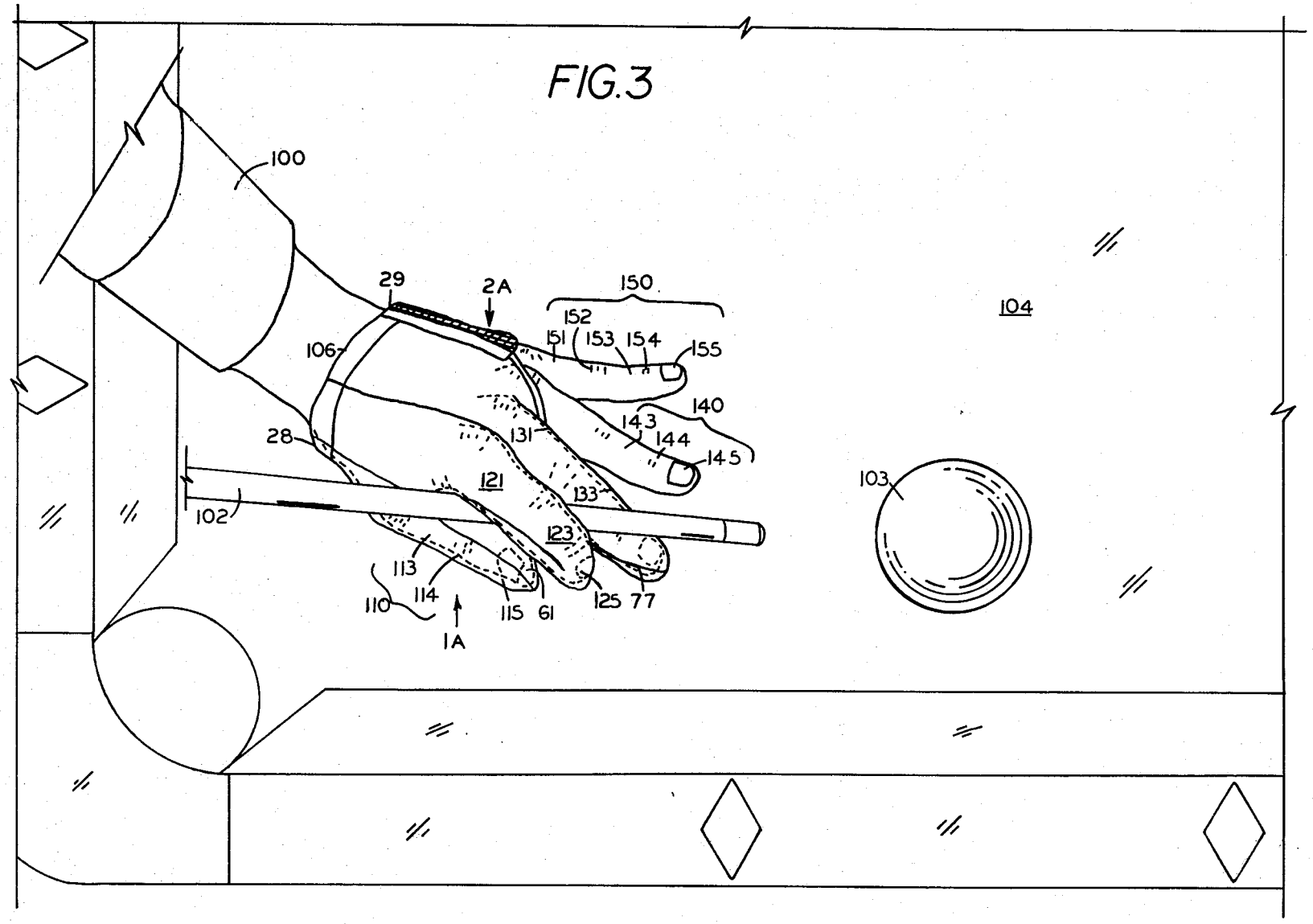

The index panel 92 also includes a thumb medial digital panel portion 61 (shown in FIG. 4): panel portion 61 is composed of:

a. a thumb digital palmar panel portion 67.6 adjacent to a palmar digital seam 63 at the ulnar edge of thumb portion 51.3; portion 67.6 extends in an ulnar direction from seam 63; and b. a dorsal portion 7.6 (shown folded out in FIG. 12; normally, as shown in FIG. 10, portion 67.6 faces dorsally of the glove when folded as in FIGS. 10 and 11 but faces in a more ulnar or quintal direction when in use as shown in FIG. 4, but more in a dorsal direction and less in an ulnar direction when in use as shown in FIGS. 1–3.

The thumb medial digital palmar portion 67.6 and its dorsal portion 31.2 are continuous across a zone of junction 62 without a seam therebetween as shown in FIGS. 12 and 15, although a seam could be provided at along line 65 (in FIG. 15). Seam 65 would be located in the middle of zone 62 of FIG. 10 and would be continuous with seam junction 68, and extend to dorsal thumb seam junction 60.

While the panels 91, 92, 93 and 94 have about 10% maximum stretch in proximal to distal direction and the same (10%) transversely thereto in thumb-ulnar direction and have a smooth exterior and interior surface to provide for sliding of the cue surface thereon, the quintal panel 80 is made of a coarse weave and to act as a porous non-slip contact surface. Panel 80 is formed of (a) one parallel group of thin transverse elastic fibers as 181 and 182 each of about 0.02 inch (0.05 cm) diameter and extending parallel to the wrist edge 25 and (b) an array of like proximally to distally extending friction pad assemblies as 193, 194 and 183 and 184. Each of the friction pad assemblies as 184 is composed of a thick multi-strand pad proximally-to-distally-extending central pad-supporting woven fiber as 185 about 0.05 inch in diameter (1.2 mm) around which are tightly woven a series of 0.02 inch thick (9.5 mm) thick transversely (ulnar-thumb) multi-fiber strands 186 and 187 (each fiber as 188 in the strand is about 0.001 inch in diameter); each strand, as 186 is about 0.10 inch (2.5 mm) wide measured in proximal to distal direction.

The transverse fibers 181 and 182 are spaced apart, proximally to distally, by 0.18 inch (0.45 cm) and firmly hold the central fibers as 185. The fibers as 181 and 182 are elastic and arranged as loops that surround fibers as 185. With the multiplicity of exteriorly projecting slip resistant masses as 185 and 186 the panel 80 forms an elastic yet exteriorly lobulated slip resistant surface when in contact with a dense felt surface as on a billiard table in the position of parts shown in FIGS. 2 and 3.

4. The Seams of the Dorsal and Palmar Assemblies

A base central palmar flexible yet firm seam 40 extends distally between the ulnar edge of the palmar surface 50.2 of the thumb panel and thumb edge of the palmar surface of the middle hand portion 42 of the palmar panel 93. This seam 40 extends distally from the palmar portion 27 of the wrist edge 25 of the glove 20 to a palmar seam junction 68 of the thumb palmer seam 63 and the palmar digital seam 79. Seam 79 is contiguous with and firmly yet flexibly joins (a) the thumb edge the distal portion of the middle hand portion 42 of panel 93 and (b) the ulnar edge of the proximal portion of the palmar digital portion 31.2 of the index panel 92. An ulnar or quintal palmar seam 45 extends distally from the palmar edge 27 of the proximal or wrist edge 24 of the middle hand panels 42 and like edge (87.6) of the quintal panel 80 of glove 20 to the distal palmar edge 84.3 of the quintal panel 80 where edge 84.3 joins the distal and ulnar edge 47 of the panel 42 and joins flexibly yet firmly the palmar thumb edge of the quintal panel 80 and the ulnar edge of the base or proximal portion of middle hand portion 42 of central palmar panel 93.

The seams as 40, 45, 76, 63, 64, 71, 72, 77, 78 and 79 are formed with strong flexible thread 0.3mm (0.02 inch) diameter in form of continuous seams with exposed portion thereof being about 14 loop portions per lineal inch, each exposed portions 0.05 inch (1.3 mm) long.

A palmar thumb seam 63 extends distally and in a thumb direction from junction 68 to thumb distal tip 54 and, as thumb dorsal seam 64, to dorsal thumb seam junction 60. Seam 63 joins the ulnar edge of the digital portion of the palmar surface 55 of the thumb panel 94 to the thumb edge of the palmar portion 66.7 of the thumb medial digital panel portion 61 of the index panel 92. These seams are shown in FIG. 11.

A dorsal center seam hand portion, 72, extends on the dorsal side or surface of the glove 20 from the dorsal portion 26 of the wrist or proximal edge 25 of the glove 20 distally and flexibly yet firmly joins the thumb edge of the base portion 36 of middle finger dorsal panel 9 and the ulnar edge of base portion 32 of dorsal index finger panel portion 30 of index panel 92. The dorsal central seam hand portion 72 extends to dorsal ulnar seam junction 69.

The dorsal digital seam 77 extends distally from junction 69 to the middle (measured in ulnar-thumb direction) of (as shown in FIG. 10) to the distal end 39 of the center panel 91. Seam 77 extends along and firmly yet flexibly joins (a) the thumb edge of the dorsal digital portion 37.8 of middle finger dorsal portion 35 of dorsal center panel 91 and (b) the ulnar edge of the dorsal portion 46.1 of the digital portion of the central palmar panel 93.

The dorsal seam 77 is continuous with palmar seam 76—the digital palmar portion of the medial seam—at tip 39. Seam 72 also joins the central palmar digital seam portion 79 at dorsal ulnar seam junction 69. (as shown in FIG. 11). A thumb palmer seam 63 joins the ulnar edge of the digital portion of the palmar surface of the thumb panel 51.3 to the thumb edge of the dorsal portion 66.7 of the thumb palmar portion of the thumb medial digital panel 61.

A thumb dorsal seam 64 as shown in FIGS. 10 and 12 extends from the dorsal thumb seam junction 60 to the distal thumb tip 54 of the thumb panel 94 and index panel 92 and is firmly attached to and holds together, (as do the other seams herein discussed and shown for the panel edges adjacent to such seams).

a. the ulnar edge of the digital portion of the dorsal surface (53.1) of the thumb panel 94 and b. the dorsal portion 67.6 of the thumb medial panel 61.

A medial seam 71 joins the ulnar edge of the dorsal base portion panel 35 to the thumb edge of the quintal panel dorsal portion 81 (shown in FIG. 10). The ulnar edge portion of the panel 35 continuous with and distal to the dorsal portion of the ulnar edge 70 of panel 35 is continuous with the base of the thumb edge 75 of the digital palmar portion 38.7 (shown in FIG. 11) and with the medial digital palmar panel seam 76. Seam 76 flexibly yet firmly joins the thumb edge of the palm portion 38.7 of the middle finger dorsal panel 92 and the ulnar edge of panel portion 41.6 of the middle finger panel 93.

These seams also determine the length of the base and digital portions of the panels 92–94 on the dorsal as well as palmar sides of glove 20.

The distance of the junctions 60 and 68 from the proximal or unit opening edge 25 is the distal extent of thumb base portions 52.0 and 50.0: the distal distance from the seam junctions 60 and 68 is also the distal distance from the proximal edge of the digital portion of thumb digital panel 53.1 and 51.3, the distal portions of which digital panels extends to the tip 54 thereof.

The distance of the junctions 60 and 69 from the dorsal portion of the proximal or wrist opening edge 26 is the distance of the distal portion of the dorsal base portion 32 of panel 30 from the edge 26. The distal distance from the junctions 69 and 60 is the distance distally from proximal edge of the digital portion of the panel 31.3, the distal portion of which panel (31.3) extends to the tip 34 thereof.

The distance of junction 69 from the dorsal portion of the proximal or wrist opening edge 26 is the distance of the distal portion of the dorsal base panel portion 36 of panel 91. The distal distance from the junction 69 is the distance from proximal edge of the digital portion 37.8 of the panel 91, the distal portion of which panel (91) extends to the tip 39 thereof.

5. Use and Operation of the Glove 20

In operation and use of glove, as shown in FIGS. 1–9. the wearer 100 of the glove 20 places his or her thumb 110 in the thumb portion 119 of the glove (formed by panels 94 and 92 as shown in FIGS. 10–15) the index finger 120 in the index finger digital portion 129 (formed by panel 92 as shown in FIGS. 10–15) and the middle finger 130 in the middle finger digital portion 139 of the glove (formed by panels 93 and 91, as shown in FIGS. 10–15.).

With the palm 105 of the wearer facing and adjacent to the interior of the palmar panel assembly 22 and the dorsum of the hand 106 adjacent the dorsal glove panel assembly 21, the ring finger 140 of the wearer's hand 101 and the fifth or little finger 150 extend from the distal or finger opening 24 of the glove as shown in FIGS. 2, 3, 4, 6, 7, and 9.

In FIGS. 1, 2, 3 and 6 the outlines of the wearer's fingers in the glove 20 are shown in dotted lines to illustrate the position of the cue relative to the seams and to fingers of the wearer.

Because the wearer's fourth and fifth fingers are exposed while the thumb and first (120) and second (130) fingers are provided with a surface on which the wooden surface of the cue 102 may freely slide, the sensitivity of the nerves of the skin on the ulnar surface of the fifth (small) and fourth (ring) finger 150 and 140, respectively, are not dulled by glove fabric but the more forceful phalanges of the second (index) finger 120 and third (middle) finger 130 have the skin thereof protected by the glove fabric from frictionally seizing the moving surface of the cue 102. However, control and guidance of the cue is not inhibited by the glove because the glove surfaces against which the cue are held are all free of seams and the cue bears against portions of the phalange skin (located between the joints) at which portions the full nervous sensitivity of the skin is experienced whereby sensing for accurate control of the cue stick is accomplished without interference by seam structures while, also, movement of the cue stick is not affected by the mechanical pressure of seams where the cue surface and glove panel fabric make contact.

Concurrently the elastic quintal panel 80 not only maintains the portions of the remaining panels 91–94 firmly in place on the wearer's fingers without binding or inhibiting the motion of the wearer's fingers and the cue therebetween but also, because of frictional engagement of the pads as 186 and 187 of panel 80 with the cloth table surface 104 provides a more secure support to wearer by frictional engagement between wearer's hand and table than a bare hand or the cloth of panels 91–94 provide.

As shown in FIGS. 1 and 2 the cue stick is held between portions of the cloth panels 31.2 and 67.6 with the portion of the panel 31.2 being that portion located between the joints 122 and 124 of the index finger; the phalanx portion 123 presses the cloth panel 31.2 against the top of the cue stick and the seams 78, 79 and 64 are all distant from the area of contact: the digital phalanx 125 is then located near the tip 34 of the index finger portion 129 of the glove 20.

The panel 67.6 of the thumb assembly then supports the cue and rests on the flesh of the thumb phalanx 113 between the crotch or junction zone 62 of the panel 61 and the joint 114 while the digital end 115 of the thumb is located near the end of the thumb portion 109 of the finger assembly of the glove 20. Joint 114 is the most distal thumb joint.

As shown in FIG. 2 during such position the phalanxes as 151–155 of the little finger 150 extend through the opening 24. The opening 24 of the glove 20 and the first phalanx 151 and 141 of the ringer finger 140 and little finger 150 are distal to the distal edges 83.4 and 84.3 of the quintal panel 80, and the skin of the fourth finger 140 is also exposed directly to the surface of the table on which the ball 103 is applied. As shown in FIG. 3, the player's hand is supported by contact with the lobular friction pad area of the panel 80.

Figure 5:
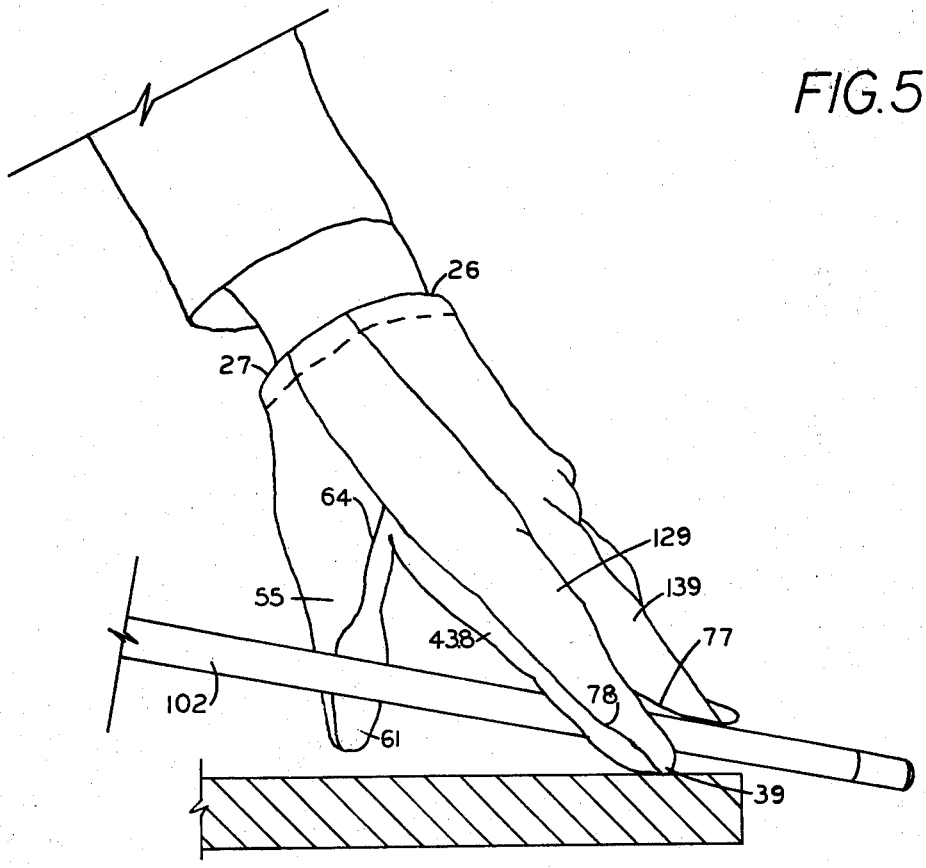

As shown in the position of cue and glove in FIGS. 4–6, the cue stick is held between (a) the vertical or thumb edge portion 98 of portions 46.1 and 41.6 of panel 42 palmar of (or below as shown in FIGS. 4–6) seam 77 and (b) the ulnar edge of digital portion of panel 42 between dorsal portion 31.3 and palmar portion 31.2, and not in contact with any seam, and below the palmar continuation of seam 88. The fleshy portion of the most distal phalanges 125 of finger 120 and 135' of finger 130 then press the adjacent cloth panel portions [(a) and (b) above] against the top of the cue stick and the seam 78 is distant from the area of contact: the digital phalanx 125 is then located near the tip 34 of the index finger portion 129 of the glove 20, and phalanx 135 is then located near the tip 39 of the middle finger portion of glove 20.

A zone of the distal portion of fabric panel 67.6 of the thumb assembly then contacts the cue and bears against the flesh of the thumb phalanx 115 distal to the distal thumb joint 114 while the digital end 115 of the thumb is located near the end of the thumb portion 109 of the finger assembly of the glove 20, and the seam 64 is proximal to yet removed from such zone, as shown in FIGS. 5 and 6.

Figure 7:
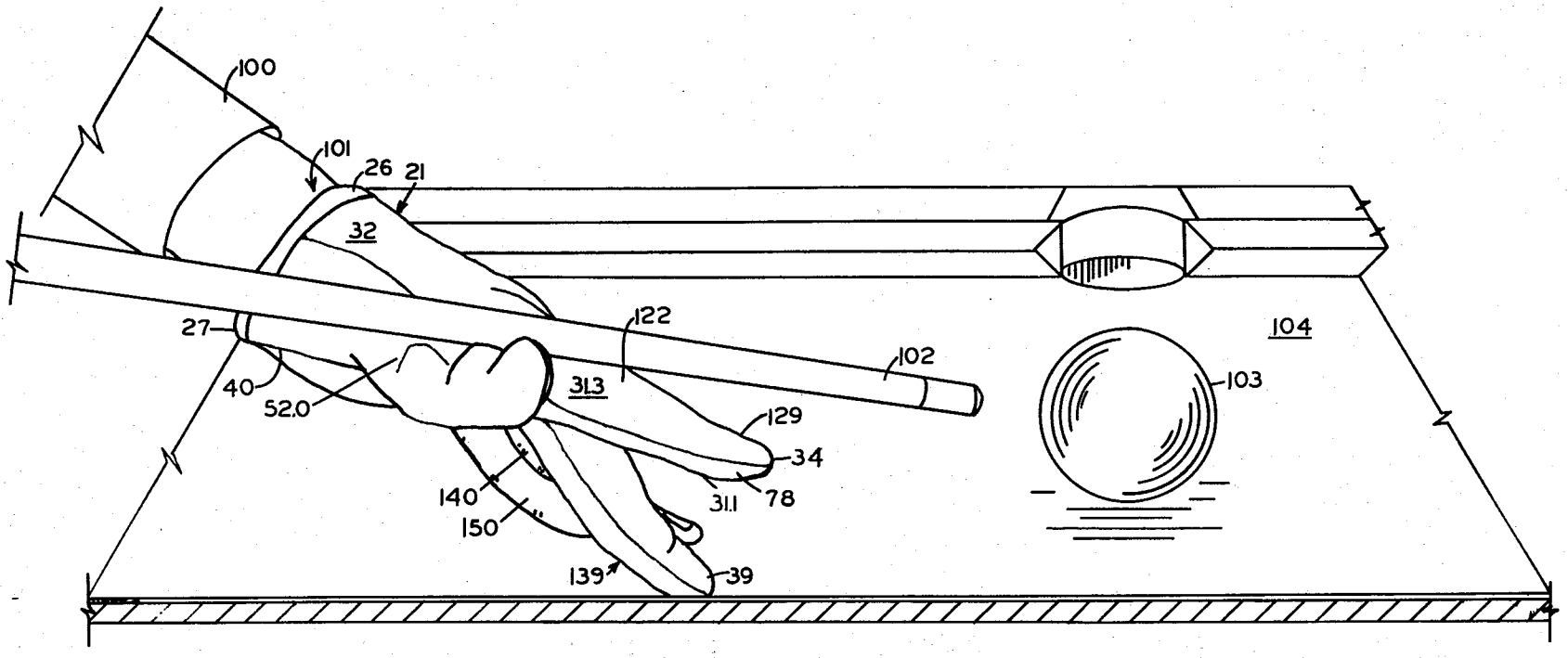
FIGS. 7, 8 and 9 show yet another position of portions of the glove apparatus 20 on the hand 101 of the wearer 100 while handling a cue 102 while addressing the cue head at a ball 103 on pool or billiard table 104 at a more elevated position of the cue relative to the height of the tips of the hand supporting finger elements than in FIGS. 1–3.
Figure 8:
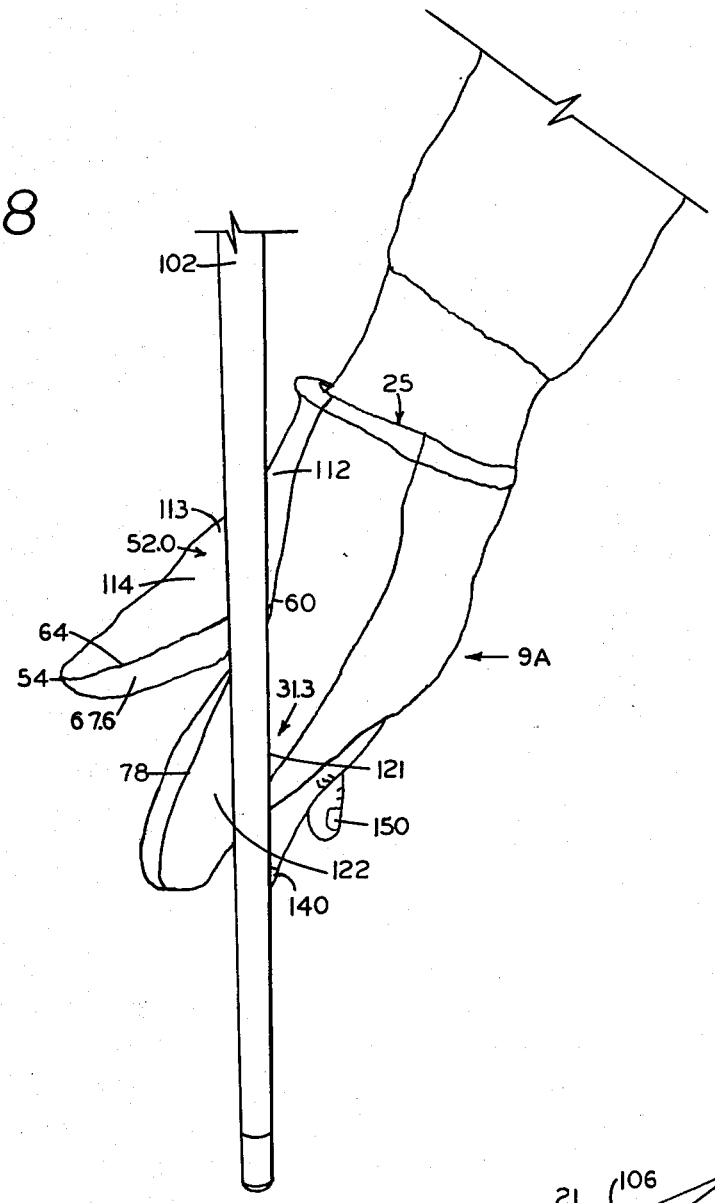
Figure 9:
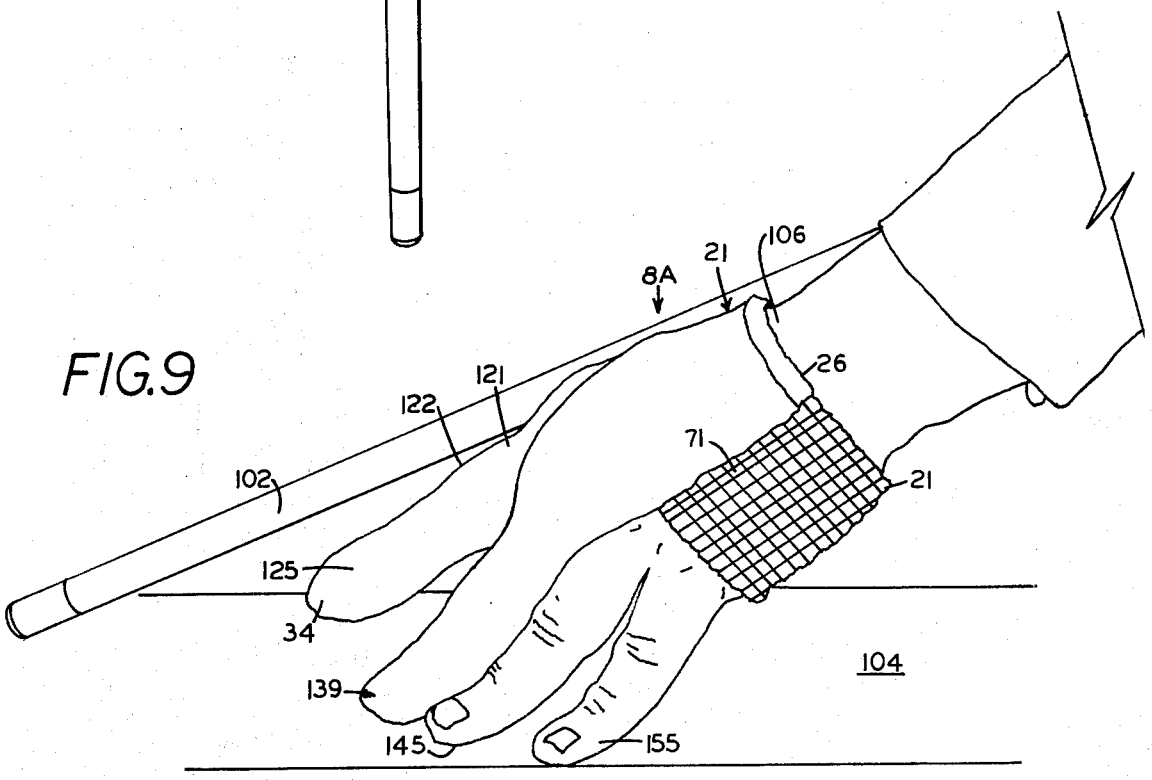

In the position of cue 102 and glove 20 and hand 101 shown in FIGS. 7–9, the cue stick is slidably supported and held on portion 31.3 of the index panel portion 52.0 of panel 94 with the portion of the panel 52.0 so contacted being that portion located dorsal to the first phalange bone and proximal to the joint 114 and distal to joint 112 while spaced away (proximally) from seam 64. The panel portion 31.3 then so contacted by the cue is that portion above the first index finger phalange bone (121) and proximal to the joint 122 and spaced away from and located (as shown in FIG. 7) above the seam 78.

In this position the control of position of the cue depends particularly greatly on the tactile sensation provided by the then exposed fourth and fifth fingers (140 and 150) with the table surface 104, and the free sliding of cue 102 on the glove portions is particularly beneficial.

In the position of FIGS. 4–6, the glove 20 provides not only the slidable guidance at zones of contact of glove and cue but also permits the full sensitivity of the bare finger tips 155 and 154.

In the position of FIGS. 1–3, the non-slip support provided by engagement of the quintal panel pad surface with the felt cloth billiard table surface 104 provides a particularly desirable firm vertical support for the wearer 100 (then with his arm extended over the table) and permits the exposed skin of the fourth and fifth fingers to be used as sensing means rather than as support means while the smooth slidable contact of the cue stick and contacted glove panel portions avoid otherwise resulting irregular movement of "grabbing" of the cue and/or dispersal of powder on the pool table surface, when bare hands or talcum powder are used with resulting interference with the uniformity of playing surface that is needed for accurate ball control thereon.

In use of the glove 20 as shown in FIGS. 1–9, the placing of the tips of the (a) index finger in the glove index finger digital portion 129, (b) middle finger 130 in glove finger digital portion 139, and (c) thumb 110 in the glove thumb portion 119 of glove 20, in cooperation with the firm fit provided by quintal panel 80 and palmar panel portions 42 and 50.2 and dorsal panel portions 36.32 and 52.0 serve to make taut and prevent the rotation of the digital portions of the panels 91–94 and around that wearer's fingers and so maintains the seams adjacent such fingers in the positions therefor above described and resiliently return them to such positions notwithstanding the changes in position of the fingers of the wearer during play as shown in FIGS. 1–9.

The preferred embodiment of glove 20 weighs ½ ounce (14 grams).

I claim:

1. A billiard glove comprising, in operative combination a. a plurality of dimensionally stable flexible palmar panel portions and a plurality of dorsal smooth surfaced flexible panel portions and an ulnar elastic panel portion forming, together, a hand enclosing and covering array of panel portions, and b. distally extending from said hand enclosing array of panel portions a plurality of finger enclosing dorsal and palmar smooth surfaced dimensionally stable flexible panel portions, one of which plurality of finger enclosing panel portions forms a covering for a player's thumb, another part of which finger enclosing dorsal and palmar panel portions comprises an array of dorsal and palmar finger covering panel portions for a player's index finger and another part of which finger enclosing distal dorsal and palmar panel portions comprises an array of dorsal and palmar smooth surfaced panel portions forming a covering for a player's middle finger and having an ulnar edge, c. said glove providing an orifice between said ulnar elastic panel and said ulnar edge of said covering for said middle finger to thereby expose the fingers of a player's hand, d. the dorsal portion of said hand enclosing array of panel portions being continuous with the dorsal portion of each of said finger covering panel portions and the palmar portions of said hand enclosing array of panel portions being continuous with the palmar portions of the finger covering panel portions, and wherein b.1. said panel portions for the player's index finger comprise a dorsal panel portion and a palmar panel portion which are continuous with each other along the medial side of said panel portions for the index finger and which are provided with a seam therebetween on the dorsal side of said index finger covering panel portions, and b.2. said panel portions for the middle finger comprises a panel which extends distally from a palmar hand portion thereof and has a dorsal distal portion and a palmar distal portion continuous with each other at the medial edge thereof and joins a seam spaced away dorsally from said medial edge, and b.3. said panel portions for a player's thumb comprises a panel which extends distally from said hand enclosing array of panels and comprises a distal dorsal portion and a distal thumb palmar portion continuous with each other along their ulnar edge and joins a seam dorsally spaced away from said ulnar edge and joined to a dorsal thumb covering panel portion.

2. Apparatus as in claim 1 wherein the ulnar portion of the hand enclosing array of panel portions has exteriorly facing friction pads adapted to engage with a fibrous felt material as generally used on a conventional billiard or pool table playing surface.

3. Apparatus as in claim 2 wherein the elastic fabric panel is distensible transversely to the length of the glove but is dimensionally stable longitudinally thereof.

4. Apparatus as in claim 1 wherein dimensionally stable seams join the panel portions of said hand enclosing assembly of panel portions and the panel portions forming said flexible coverings for the fingers and said seams are located at points spaced away from cue contacting zones of said glove.

* * * * *